United States Patent [19]

Paulus et al.

[11] 4,065,329

[45] Dec. 27, 1977

[54] CONTINUOUS HEAT TREATMENT OF COLD ROLLED STEEL STRIP

[75] Inventors: Philippe Paulus; Mario Econompoulos, both of Liege, Belgium

[73] Assignee: Centre de Recherches Metallurgiques-Centrum voor Research in de Metallurgie, Brussels, Belgium

[21] Appl. No.: 649,597

[22] Filed: Jan. 16, 1976

[30] Foreign Application Priority Data

Jan. 17, 1975 Luxembourg ..... 76664

[51] Int. Cl.[2] ..... C21D 1/48

[52] U.S. Cl. ..... 148/18; 148/12.4; 148/27; 148/143

[58] Field of Search ..... 148/12.4, 18, 143, 144, 148/153, 155, 156, 27, 28, 16, 112; 266/4 R

[56] References Cited

U.S. PATENT DOCUMENTS

| | | | |
|---|---|---|---|
| 3,022,205 | 2/1962 | Chase et al. | 148/28 |
| 3,030,240 | 4/1962 | Crombie et al. | 148/16 |
| 3,254,990 | 6/1966 | Goering et al. | 148/112 |
| 3,669,762 | 6/1972 | Takeo et al. | 148/28 |
| 3,785,878 | 1/1974 | Economopoulos | 148/18 |
| 3,877,684 | 4/1975 | Kurihara et al. | 148/156 |

OTHER PUBLICATIONS

Lyman (Edi); *Metals Handbook,* vol. 2, "Heat-Treating", Ohoo, 1964 (ASM) p. 16.

*Primary Examiner*—Walter R. Satterfield
*Attorney, Agent, or Firm*—Holman & Stern

[57] ABSTRACT

Cold-rolled steel strip is heated to a temperature higher than its recrystallization temperature, preferably faster than 4° C/s. The strip is then held for more than 30 seconds. The strip is then cooled by immersion in an aqueous bath maintained at substantially its boiling temperature within a temperature range of 80°-150° C.

9 Claims, 3 Drawing Figures

CONTINUOUS HEAT TREATMENT OF COLD ROLLED STEEL STRIP

BACKGROUND OF THE INVENTION

The present invention relates to a continuous heat treatment of cold-rolled steel strip.

Heat treatment is particularly important for giving strip an excellent limit of elasticity combined with high elongation (at fracture) and homogeneity of properties throughout its width, which results in satisfactory drawability. Such qualities are particularly desirable for strip with high limit of elasticity used in the car industry.

When one wishes to obtain good ductility, drawability, and elongation in cold-rolled strip, the strip is generally subjected to coil recrystallization annealing in a bell furnace. Such treatment, however, is expensive because it is of long duration and thus of low productivity; moreover, the results attained with this treatment are quite variable. To remedy such inconveniences, it has already been suggested to replace such an annealing treatment with a continuous heat treatment. However, notwithstanding various suggested modifications, it is still impossible to obtain every time satisfactory homogeneity in the properties of the strip throughout its width and good ductility, while maintaining an acceptable treatment duration.

SUMMARY OF THE INVENTION

The invention is based on the fact that, in view of the production to be ensured and a reasonable total length of the production line, the total duration of the heat treatment cycle is limited to a few minutes. During this period, the treatment must ensure: at least partial recrystallization of the structure of the cold-rolled sheet; development of a favorable structure for drawing; grain growth to the desired grain size; and precipitation of the interstitial carbon in the form of carbides.

The present invention provides a process in which cold-rolled steel strip undergoes a heat treatment comprising a heating operation followed by a rapid cooling operation, and in which during the heating operation the strip is heated to a temperature higher than its recrystallization temperature, and during the cooling operation the sheet thus heated is immersed in an aqueous bath maintained substantially at its boiling temperature.

The heating is preferably performed at a rate higher than 4° C per second.

Although the aqueous bath in which the strip is immersed to be rapidly cooled may consist of water alone, it may alternatively advantageously contain, in suspension and/or in solution, one or more substances capable of modifying its heat transfer coefficient, for example salts (particularly calcium chloride or borax) or surfactants (such as sodium and potassium palmitates, stearates, and oleates), and/or one or more anticorrosive substances.

Depending on the composition of the aqueous bath in which the strip is immersed to be cooled, and depending on the pressure in the space above the bath, the boiling temperature of the bath may be 80° C to 150° C. The cooling rate imposed by immersing the strip in the aqueous bath is preferably 35° C to 250° C per second.

In order to obtain as complete as possible a recrystallization of the cold-rolled structure of the strip, the strip is preferably maintained at a temperature equal or possibly intermediate to the end-heating temperature and the temperature of starting of rapid cooling during a time longer than 30 seconds.

It may be advantageous for the strip cooled by immersion in the aqueous bath to be kept in the bath for a time of 10 seconds to 2 minutes.

The strip cooled by immersion in the aqueous solution may advantageously undergo an annealing or overageing operation comprising heating the strip to a temperature of 300° C to 500° C, which permits the ductility to be improved. The strip is preferably maintained at that temperature for a time longer than 15 seconds.

In a process for production of strip with a high limit of elasticity, the strip is heated to a temperature higher than its recrystallization temperature, the strip is maintained for more than 30 seconds at a temperature between the temperature attained at the end of heating and the temperature from which rapid cooling starts, the latter temperature being between 800° C and 1000° C (preferably between 850° C and 960° C), and the sheet is then immersed for a time longer than 10 seconds in an aqueous bath at its boiling temperature so that the strip is brought to a temperature of 80° C to 150° C. Should strip with a high limit of elasticity and a higher ductility be required, the strip is reheated after emerging from the aqueous bath to a temperature of 300° C to 500° C for a time longer than 15 seconds.

The various operating conditions described above can also be applied in the case where homogeneous cooling carried out at the cutomary rate (35° to 250° C per second) is required, for example for annealing sheets for drawing or for producing galvanized strip with high limit of elasticity or white iron strip with high hardness and ductility or even stainless steel strip, provided the conditions are adjusted in accordance with the nature of the metal.

An installation for performing the above described process, comprises a heating furnace for bringing the strip to a temperature higher than its crystallization temperature and possibly for maintaining the sheet at such temperature for a pre-determined time, a tank containing an aqueous bath maintained practically at its boiling temperature, the strip being destined to be immersed in the bath to be cooled and possibly maintained at the end cooling temperature for a pre-determined time, possibly an annealing furnace to bring the sheet thus cooled to a temperature of about 400° C and, if necessary, to keep it at this temperature for a pre-determined time, means for cooling the sheet to the ambient temperature after its annealing at 400° C, and means for uncoiling the sheet at the beginning of the treatment and for coiling it at the end of the treatment.

BRIEF DESCRIPTION OF THE DRAWINGS

The invention will be described further, by way of example only, with reference to the accompanying drawings, in which.

DETAILED DESCRIPTION OF THE PREFERRED EMBODIMENTS

Figure 1:
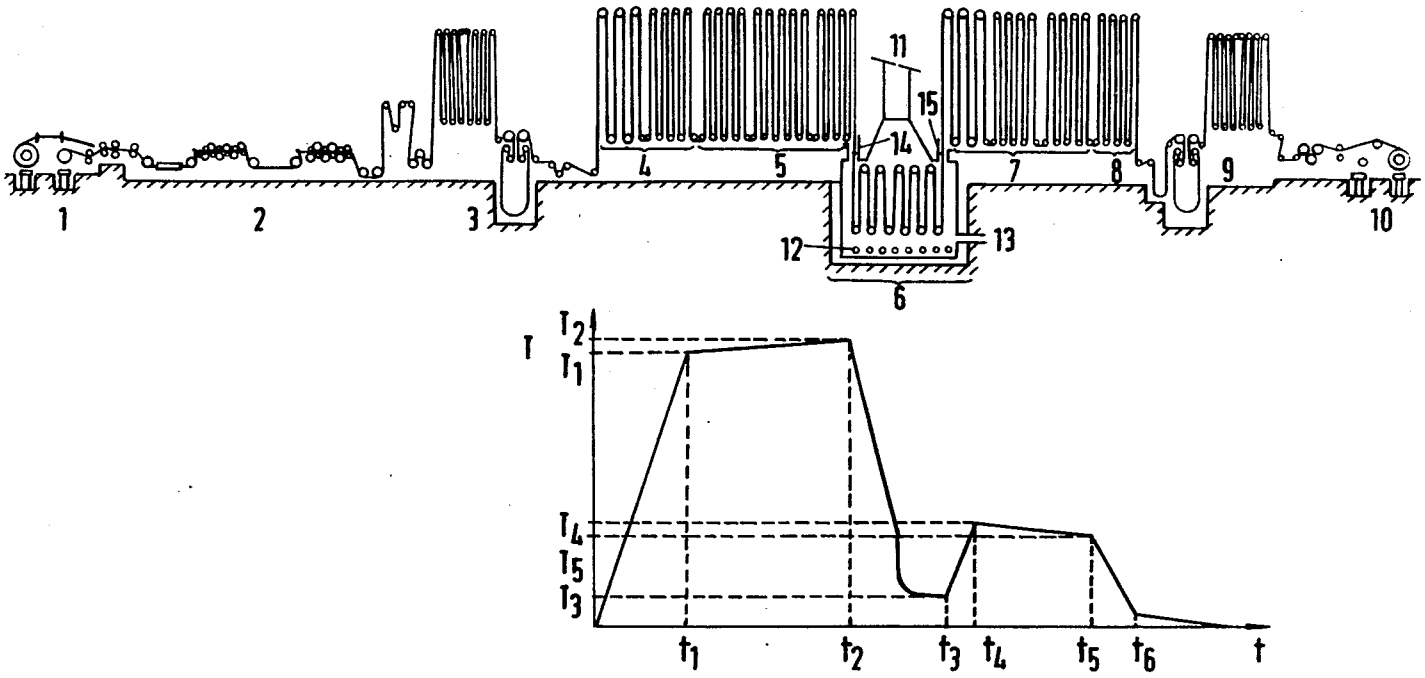
FIG. 1 diagrammatically shows an installation for treating cold-rolled steel strip, in conjunction with a graph of the course of the temperature of the strip against time during heat treatment.

The graph in FIG. 1 shows the course of the temperature of the strip against time (temperature in degrees centigrade as ordinates, time in minutes as abscissae). Cold-rolled steel strip to be treated is heated to a temperature $T_1$, i.e. a temperature higher than its recrystallization temperature, and is maintained between this temperature and a temperature $T_2$ of beginning of rapid cooling during a time from $t_2$ to $t_2$. At the time $t_2$, the strip is immersed in a tank or vessel of boiling water and its temperature rapidly decreases from $T_2$ to $T_3$.

It should be noted that the cooling diagram of the sheet comprises in fact two stages: a first stage (up to about 350° C) during which the cooling rate seems to be restricted, which phenomenon is probably due to formation of water vapor acting as a heat shield on the strip, and a second stage (until $T_3$) during which the temperature decreases very rapidly to attain the boiling water temperature. This way of cooling is very advantageous because on the one hand it permits formation of martensite to be avoided (first stage), and on the other hand, it allows the length of the installation to be substantially reduced with respect to other installations used at present.

The sheet is maintained at the temperature $T_3$ until $t_3$, then the strip is reheated to an annealing temperature $T_4$ until $t_4$. The strip is annealed until $t_5$ and is then cooled from $T_5$ (the temperature at the end of annealing) down to a temperature sufficiently low to avoid oxidation in air, the temperature being reached at time $t_6$.

The installation used for performing the process described above comprises the following means, also shown in FIG. 1:

a. an inlet device 1 comprising a coil unwinder and a welding machine;

b. optionally, an electrolytic-decreasing chamber 2 to remove rolling oils (if any);

c. an inlet accumulator 3;

d. a heating furnace 4;

e. a chamber for maintaining the strip at a temperature close to that chosen as the starting point for the rapid cooling;

f. a treatment vessel 6 containing boiling water and having a condensing device 11 for steam recovery, a water pre-heating device 12, a water supply device 13, an inlet seal 14, and an outlet seal 15;

g. an annealing furnace 7;

h. an end cooling zone 8; and i. an output device 10 comprising a coil winder, shears, optional lateral shears, a straightener, a skin-pass rollstand, and a conditioning line.

EXAMPLE 1: STRIP FOR DRAWING

A 17 ton ingot of rimming steel was produced in a foundry in the conventional manner. The ingot was transformed into a thick slab and hot-rolled with the following features:

temperature at the end of the hot-rolling: 885° C
winding temperature: 620° C
final thickness: 2.5 mm.

The composition of the product thus obtained was, in wt. %:

| C | Mn | Si | P | S | Al |
|---|---|---|---|---|---|
| 0.028 | 0.240 | 0.004 | 0.009 | 0.011 | — |

The coiled strip was de-scaled by means of hydrochloric acid and than cold-rolled with a reduction of 60% to achieve a final thickness of 1 mm.

Samples of cold-rolled strip were taken and treated as follows:

Cycle A

Annealing in accordance with the conventional procedure in the coiled state in a furnace at 700° C for 12 hours. Skin-pass at a reduction rate of 1%.

Cycle B

In accordance with the invention:

a. heating for 1 minute to 800° C,
b. holding at this temperature for 1 minute,
c. immersion in boiling water for 30 seconds,
d. treatment in a furnace at 400° C for 1 minute,
e. final cooling to ambient temperature, and
f. skin-pass at a reduction rate of 1%.

Cycle C a. heating for 1 minute to 800° C,
b. holding at this temperature for 1 minute,
c. slow cooling (20° C/s) to ambient temperature,
d. treatment in a furnace at 400° C for 1 minute,
e. final cooling to ambient temperature, and
f. skin-pass at a reduction rate of 1%.

Specimens were cut away for mechanical tests. Some of these samples underwent an artificial ageing treatment for 1 hour at 100° C before mechanical tests.

The properties obtained were as follows:

| | Properties before ageing | | | | | | | |
|---|---|---|---|---|---|---|---|---|
| Treatment | D (mm) | E (kg/2 mm | UTS (kg/2 mm | e (%) | r | n | l (%) | l after ageing (%) |
| Cycle A | 11.6 | 20.0 | 30.0 | 45 | 1.15 | 0.220 | 2.0 | 9.0 |
| Cycle B | 11.4 | 21.7 | 32.3 | 42.2 | 1.43 | 0.205 | 0 | 0.4 |
| Cycle C | 10.9 | 23.4 | 34.6 | 38.0 | 1.35 | 0.195 | 1.5 | 4.0 |

D = Erichsen depth (deep drawing test)
E = elastic limit (or 0.2% proof stress)
UTS = ultimate tensile stress
e = elongation at fracture (gauge length 50 mm)
$\bar{r}$ = normal anisotropy coefficient
n = strain hardening coefficient
l = length of the flat part of the tensile curve $D$ = Erichsen depth (deep drawing test)
$E$ = elastic limit (or 0.2% proof stress)
$UTS$ = ultimate tensile stress
$e$ = elongation at fracture (gauge length 50 mm)
$r$ = normal anisotropy coefficient
$n$ = strain hardening coefficient
$l$ = length of the flat part of the tensile curve It should be noted that cycle B (according to the invention) allows in a very short time properties comparable to those obtained by the conventional procedure to be obtained, the properties obtained being even better as far as the normal anisotropic coefficient $\bar{r}$ and the ageing properties are concerned. A too slow cooling speed (cycle C) does not result in satisfactory properties.

EXAMPLE 2: STRIP WITH HIGH LIMIT OF ELASTICITY.

In an electric furnace there was obtained 500 kg of steel of the following composition (wt.%):

| C | Mn | Si | P | S | Al |
|---|---|---|---|---|---|
| 0.060 | 1.070 | 0.265 | 0.012 | 0.015 | 0.035 |

This steel was hot rolled with the following characteristics:

hot-rolling final temperature: 910° C, coiling temperature: 580° C, final thickness: 2.7 mm.

The coil thus obtained was de-scaled by treatment with hydrochloric acid and the cold-rolled with a reduction of 63% to achieve a thickness of 1 mm.

Samples were then taken and heat treated as follows:

Cycle A:

a. heating to 900° C in 1 minute, b. holding at 900° C for 1 minute, c. immersion in boiling water for 30 seconds (20 seconds for cooling to 100° C and 10 seconds for maintaining at 100° C), and d. final cooling to ambient temperature.

Cycle B:

a. heating to 920° C in 1 minute, b. holding at 920° C for 1 minute, c. immersion for 20 seconds in boiling water to decrease the temperature to 100° C, d. annealing for 3 minutes in a furnace at 350° C, and e. final cooling to ambient temperature.

Cycle C:

a. heating to 940° C in 90 seconds, b. maintaining between 940 and 960° C for 90 seconds, c. immersion in boiling water for 40 seconds (starting temperature: 960° C), d. annealing for 2 minutes in a furnace at 400° C, and e. final cooling to ambient temperature.

Cycle D:

a. heating to 900° C in 1 minute, b. holding at 900° C for 1 minute, c. quenching in cold water at a cooling rate of the order of 500° C/s, d. annealing at 400° C for 3 minutes, and e. final cooling to ambient temperature.

Cycle E:

a. heating to 900° C in 1 minute, b. holding at 900° C for 1 minute, c. slow cooling (20° C/s) to ambient temperature, d. annealing at 400° C for 3 minutes, and e. final cooling to the ambient temperature.

The products thus obtained had the following properties:

| | Cycle A | Cycle B | Cycle C | Cycle D | Cycle E |
|---|---|---|---|---|---|
| E(kg/mm²) | 44 | 42 | 40.7 | 46 to 53 | 37.4 |
| UTS (kg/mm²) | 50.2 | 48.1 | 47.5 | 59.3 to 70.8 | 45.6 |
| e (%) | 30.0 | 32.2 | 32.9 | 11 to 18 | 28.4 |
| n | 0.197 | 0.198 | 0.197 | — | 0.206 |
| r | 1.12 | 1.14 | 1.05 | — | 1.05 |
| D(mm) | 10.4 | 10.55 | 10.5 | 9.5 | 10.3 |

For comparison purposes, it should be noted that this steel in the hot-rolled state and after conventional annealing in the form of closed coils in a furnace at 700° C for 12 hours had the following properties:

| | hot-rolled state (thickness 2.7 mm) | after cold-rolling and conventional annealing |
|---|---|---|
| E (kg/mm²) | 38.0 | 28.6 |
| UTS (Kg/mm²) | 49.2 | 41.3 |
| e (%) | 28.2 | 36.1 |
| r | 0.147 | 0.202 |

It should be noted that the three cycles A, B, and C (according to the invention) permit one to obtain very favorable combinations of limit of elasticity and elongation. Cycle D, on the other hand, produces quite variable properties and an insufficient elongation, whereas steel treated according to cycle E, while exhibiting lower elongation than for the cycles A, B, and C, also has a lower limit of elasticity.

The treatments performed in accordance with the invention thus allow a higher strength in the cold-rolled product than the strength of a high-strength hot-rolled sheet, while maintaining the properties of ductility and the drawing characteristics of a cold-rolled steel of ordinary qualities. The progress is even more considerable with respect to conventional annealing because the limit of elasticity increases from 28 to 42 kg/mm², the elongation being only lowered by 4%.

EXAMPLE 3: STEEL WITH A HIGH ULTIMATE TENSILE STRESS AND HIGH ELONGATION

In the same manner as that described in Example 2, two steels with the following composition (wt.%) were obtained:

| Steel | C | Mn | Si | P | S | Al |
|---|---|---|---|---|---|---|
| L | 0.075 | 1.74 | 0.63 | 0.018 | 0.022 | 0.048 |
| G | 0.057 | 1.46 | 0.239 | 0.015 | 0.021 | 0.036 |

Samples of these steels, in the cold-rolled state, were treated according to the invention as follows:

Cycle A:

a. heating to 900° C in 80 seconds, b. holding at 900° C for 40 seconds, c. treatment in boiling distilled water for 25 seconds, and d. final cooling to ambient temperature.

Cycle B:

a. heating to 900° C in 80 seconds, b. holding at 900° C for 40 seconds, c. treatment in boiling distilled water for 25 seconds, d. treatment in a furnace at 400° C for 3 minutes, and e. final cooling to ambient temperature.

The following properties were obtained:

| Steel | Cycle | E (kg/mm²) | UTS (kg/mm²) | e % | 1 % |
|---|---|---|---|---|---|
| G | A | 40.4 | 61.5 | 29.9 | 1.7 |
| | B | 46.8 | 57.8 | 29.5 | 4.0 |
| L | A | 35.5 | 63.9 | 27.6 | 0.0 |
| | B | 48.2 | 60.2 | 27.2 | 3.0 |

It should be noted that it is possible to modify the analysis of the steel in order to obtain a stronger quenching effect and to decrease the (limit of elasticity)/(ultimate tensile strength) ratio, thereby eliminating the flat part of the tensile curve, as well maintaining the latter together with a high limit of elasticity on performing an annealing operation.

Figure 2:
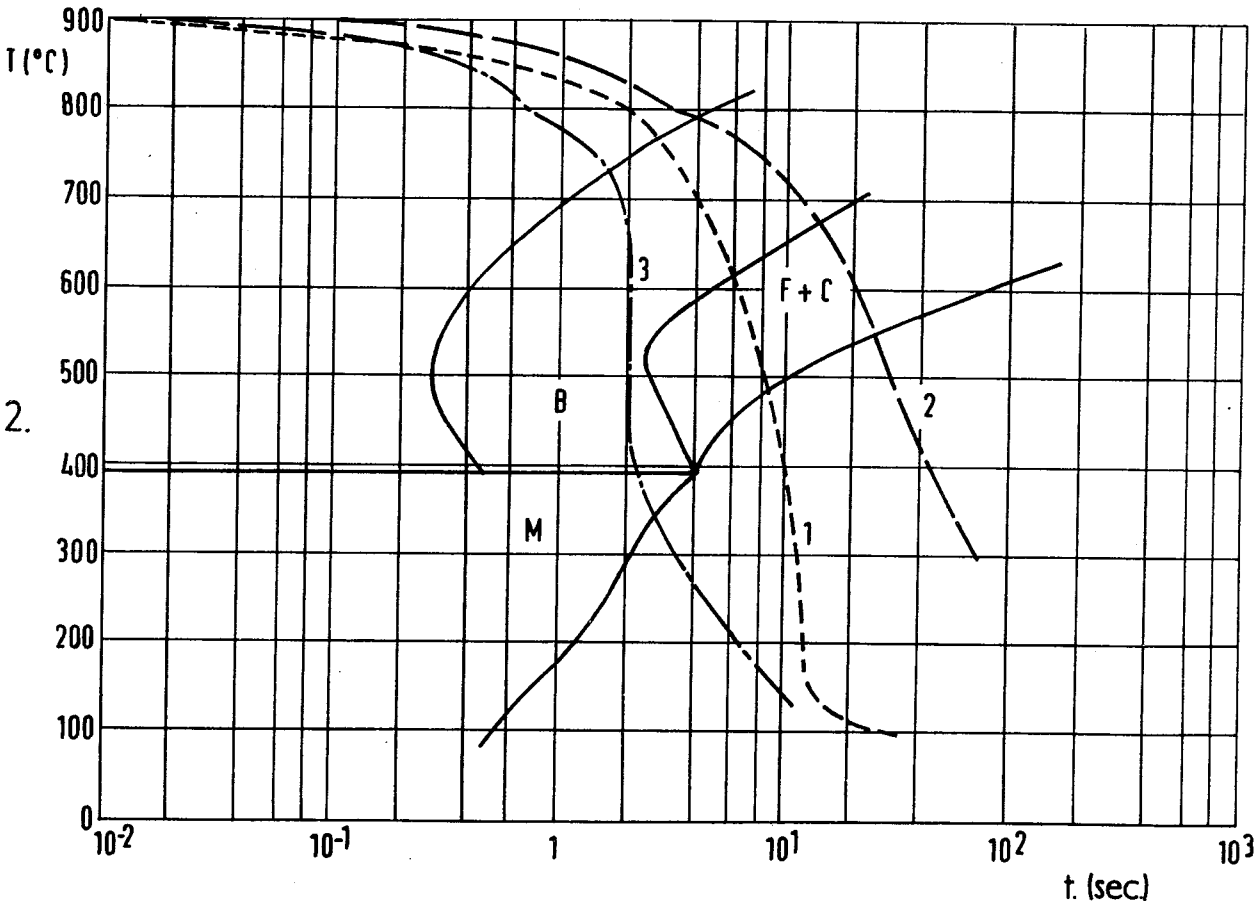
FIG. 2 is a continuous cooling transformation (CCT) diagram which illustrates a cooling operation according to the present invention, in comparison with air cooling and water quenching.

FIG. 2 illustrates well the difference between a treatment in accordance with the invention and those including cooling in the air and a water quenching, by means of the CCT diagram of the steel of Example 2. In FIG. 2, temperature in degrees centigrade is shown as ordinates and time in seconds is shown as abscissae (logarithmic coordinates).

Cooling curve No. 1 represents a cooling process in accordance with the present invention. Curve No. 2 represents cooling in the air, and curve No. 3 represents cooling in cold water. It is to be noted that curve No. 1 is located between the other two curves.

Figure 3:
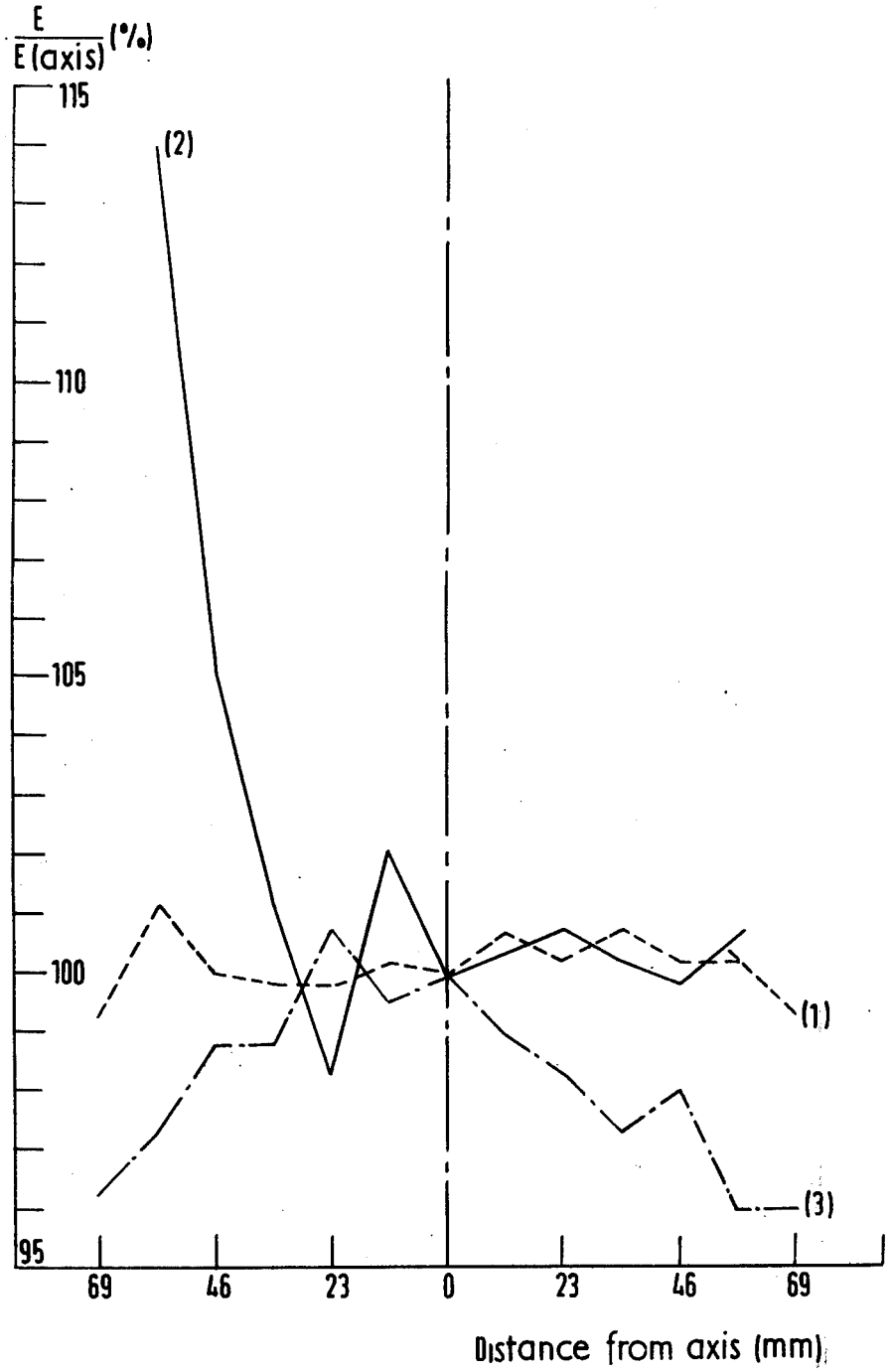
FIG. 3 is a graph of variations of the limit of elasticity across the width of the strip.

FIG. 3 clearly shows the heterogeneity of the limit of elasticity transverse to strip cooled with cold water (line No. 2) or in the still air (line No. 3) with respect to strip quenched in boiling water (line No. 1) according to the process of the invention. Distances from the axis (in mm) are shown as the abscissae, whereas the limit of elasticity measured lengthwise is shown as the ordinate as a percentage of its value at the axis of the strip.

For the strip quenched in boiling water (line No. 1), the variation of the limit of elasticity is of the same order (1 to 2%) as the error of measurement of the strip thickness. In contrast, the variation is much more significant and indicates a real heterogeneity with the other two cooling procedures.

I claim:

1. In a process for continuously heat-treating steel elongated products to increase the limit of elasticity, ductility and homogeneity of properties throughout its width, including the steps of heating the product to a first temperature between its recrystallization temperature and 1000° C, maintaining the process at the first temperature for at least 30 seconds to recrystallize the product and quenching the product, the improvement being that the product is a cold-rolled strip, and providing an aqueous bath quenching medium maintained at a temperature selected to yield a strip product exhibiting a deviation in elastic limit in the direction of width less than ± 3% from the value at the longitudinal axis, which temperature is substantially the boiling point of the bath within a range of 80° to 150° C, immersing the strip in said bath for a time of from 10 seconds to 2 minutes to cool the strip to a second temperature, then further cooling the strip to ambient temperature.

2. The process as claimed in claim 1, in which the heating step is performed at a rate higher than 4° C/s.

3. The process as claimed in claim 1, in which the aqueous bath consists of water only.

4. The process as claimed in claim 1, in which the aqueous bath contains in solution or suspension at least one material which modifies the heat transfer coefficient of the aqueous bath.

5. The process as claimed in claim 4, in which the material is a salt selected from the group consisting of calcium chloride and borax or a surfactant selected from the group consisting of sodium palmitate, potassium palmitate, sodium stearate, potassium stearate, sodium oleate and potassium oleate.

6. The process as claimed in claim 1, in which the aqueous bath contains in solution or suspension at least one material reducing corrosion of the strip.

7. The process as claimed in claim 1, in which the cooling rate of the strip in the aqueous bath is 35° to 250° C/s.

8. The process as claimed in claim 1, further comprising heating the cooled strip to a temperature of 300° to 500° C.

9. The process as claimed in claim 7, in which the temperature is maintained for longer than 15 seconds.

* * * * *